US007587775B2

(12) United States Patent
DeFranks et al.

(10) Patent No.: US 7,587,775 B2
(45) **Date of Patent: *Sep. 15, 2009**

(54) MATTRESS WITH REMOVABLE TOP

(75) Inventors: Michael S. DeFranks, Decatur, GA (US); Kurtis A. Ling, Alpharette, GA (US); Joyce A. Handley, Atlanta, GA (US); James R. Peavyhouse, Lilburn, GA (US); Ruben M. Ortiz, Atlanta, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/077,632

(22) Filed: Mar. 19, 2008

(65) Prior Publication Data

US 2008/0172796 A1 Jul. 24, 2008

Related U.S. Application Data

(63) Continuation of application No. 11/184,506, filed on Jul. 18, 2005, now Pat. No. 7,370,380.

(60) Provisional application No. 60/588,521, filed on Jul. 16, 2004.

(51) Int. Cl.
*A47C 27/00* (2006.01)

(52) U.S. Cl. ..... 5/698; 5/691; 5/737; 5/738; 5/699; 5/483; 5/484; 5/954

(58) Field of Classification Search ..... 5/691, 5/738, 737, 698, 483, 954, 699, 484, 939, 5/922, 923, 486, 496, 413 R
See application file for complete search history.

(56) References Cited

U.S. PATENT DOCUMENTS 2,064,458 A * 12/1936 Bulpit et al. ..... 5/413 R
2,151,462 A * 3/1939 Bulpit et al. ..... 5/413 R
2,632,187 A 3/1953 Wooffendale
2,689,961 A 9/1954 Lieberthal
2,895,145 A 7/1959 Soifer
3,287,749 A 11/1966 Marisco
3,493,980 A 2/1970 Haller
3,510,889 A * 5/1970 Peterson ..... 5/413 R
3,581,322 A 6/1971 Marisco
3,584,323 A * 6/1971 Worley ..... 5/413 R
3,813,715 A 6/1974 Sookne
4,069,526 A * 1/1978 Deikel ..... 5/486
4,164,797 A 8/1979 Golembeck
4,234,983 A 11/1980 Stumpf
4,388,738 A 6/1983 Wagner
4,424,600 A 1/1984 Callaway
4,430,765 A 2/1984 Karpen
4,435,864 A 3/1984 Callaway (Continued)

*Primary Examiner*—Robert G Santos
(74) *Attorney, Agent, or Firm*—Ropes & Gray LLP

(57) ABSTRACT

A mattress is constructed from a mattress body having an upper and a lower deck, which is preferably pervious to moisture and air. A removable panel, which includes a top layer of breathable fabric, a bottom layer of a fabric that forms a moisture barrier, and a batting layer, is placed on at least the upper deck of the mattress body. The removable panel is removably attached along the perimeter of the deck or decks by a fastener, such as a zipper. The panel can be removed from the deck for cleaning and folded and secured by the fastener in an inverted configuration, with the top layer facing outward.

21 Claims, 8 Drawing Sheets

U.S. PATENT DOCUMENTS 4,449,261 A 5/1984 Magnusson
4,513,461 A * 4/1985 Tardivel ..... 5/413 R
4,549,323 A 10/1985 Brockhaus
4,566,926 A 1/1986 Stumpf
4,573,227 A * 3/1986 Prandina ..... 5/486
4,809,375 A 3/1989 Bull
5,005,235 A * 4/1991 Huang ..... 5/413 R
5,136,741 A 8/1992 Balonick et al.
5,249,320 A 10/1993 Moretz et al.
5,289,602 A 3/1994 Trader
5,311,624 A 5/1994 Hutchinson
5,414,882 A 5/1995 Goodale
5,475,881 A 12/1995 Higgins et al.
5,562,977 A 10/1996 Jager et al.
5,566,411 A 10/1996 Eiler
5,628,093 A 5/1997 Goodale
5,655,241 A 8/1997 Higgins et al.
5,950,264 A 9/1999 Wyner et al.
6,174,584 B1 1/2001 Keller et al.
6,199,234 B1 3/2001 Srour et al.
6,243,900 B1 6/2001 Gladney et al.
6,277,770 B1 8/2001 Smith, III et al.
6,511,927 B1 1/2003 Ellis et al.
6,901,618 B2 6/2005 Oakhill et al.
6,954,957 B2 10/2005 Metzger et al.
6,966,090 B2 11/2005 McClintock et al.
6,971,130 B2 12/2005 Chase
7,007,329 B2 3/2006 Metzger
7,150,059 B2 12/2006 Small, Jr. et al.
7,181,785 B2 * 2/2007 Dinan et al. ..... 5/413 R
7,225,487 B2 6/2007 Small, Jr. et al.
7,370,380 B2 * 5/2008 DeFranks et al. ..... 5/691
2001/0008030 A1 7/2001 Gladney et al.
2003/0029943 A1 2/2003 Malsam et al.
2003/0129904 A1 7/2003 Wolynes et al.
2004/0216237 A1 11/2004 Metzger
2006/0010608 A1 1/2006 DeFranks et al.
2006/0236462 A1 10/2006 Boyd
2007/0174962 A1 8/2007 Smith
2007/0199155 A1 8/2007 Thygsen
2007/0256246 A1 11/2007 Gladney et al.
2008/0172796 A1 * 7/2008 DeFranks et al. ..... 5/698

* cited by examiner

MATTRESS WITH REMOVABLE TOP

CROSS-REFERENCE TO OTHER PATENT APPLICATIONS

This application is a continuation of U.S. patent application Ser. No. 11/184,506, filed Jul. 18, 2005, which claims the benefit to U.S. provisional Patent Application No. 60/588,521, filed Jul. 16, 2004, the contents of each of which are incorporated herein by reference in their entirety.

BACKGROUND

A mattress is an important purchase and is intended to provide the user with a sleeping surface that can last for years. However, like any piece of furniture, a mattress during normal use, may be exposed to a substantial amount of wear, as well as to accidental spillage that can stain and/or degrade the mattress upholstery and the mattress core. During normal use, the mattress is typically protected only by a sheet and an optional mattress pad, and as such, the mattress is subject to damage due to perspiration from a sleeping occupant, coffee spills and the like. Although an impervious top sheet, made for example of plastic, can be placed over the top mattress upholstery, as is customary in hospital settings and with children, such sheet is uncomfortable to sleep on because perspiration cannot be absorbed. Normal bed sheets offer little protection for the mattress, because fluids easily pass through the sheets into and possibly through the top portion of the mattress. Once soiled, a mattress can be flipped over, but will eventually have to be cleaned which is difficult, uneconomical and rarely satisfactory. At this time, disposal of the soiled mattress and replacement with a new mattress is the most effective procedure to obtain a clean mattress, which is particularly important in hotels, motels, dormitories, barracks, some hospitals, some nursing homes, institutions of various natures, furnished apartments, and any similar environment having a relatively high turn-over of persons using the mattresses.

Mattress covers, including removable mattress covers that attach to the body of the mattress, have been made and sold over the years. Typically, these mattress covers provide some moisture protection for the mattress core by providing a removable cover that extends across the sleeping surface. One example of such a mattress is described in U.S. Pat. No. 3,581,322, and includes a waterproof outer panel that includes a foam pad and that has a zipper for attaching to the body of the mattress. This waterproof outer panel may be removed when necessary and cleaned. Another example of a mattress having a removable cover is described in U.S. Pat. No. 4,809,375 and discloses a mattress pad that is waterproof, removable and has fill material that may be selected by the user to achieve a desired level of firmness at the sleeping surface.

Although, these mattresses provide a useful removable waterproof cover, they themselves are bulky and difficult to clean, and very difficult to clean effectively.

It would therefore be desirable to provide a removable cover for a mattress that efficiently protect the mattress, is easy to clean, offers comfort for the sleeping occupant, and allows the mattress to breathe.

SUMMARY

The systems and methods described herein are directed, inter alia, to bedding articles, such as mattresses, with a mattress body having an upper and a lower deck and at least one perimeter section encircling at least the upper deck, wherein the upper and lower deck are impervious to moisture and air. The mattress further includes a removable panel disposed on at least the upper deck of the mattress body, and a fastener for removably attaching a perimeter of the removable panel to at least the perimeter section of the upper deck. The removable panel is composed of at least a top layer of breathable fabric, a bottom layer of a fabric that forms a moisture barrier, and a batting layer, wherein at least said top layer and batting layer being are quilted together to form a comfortable sleeping surface.

Embodiments may include one or more of the following features. The top layer of fabric may include fibers with channels dimensionally adapted to enhance air and moisture permeability. The batting layer may include a polyester fiber material, a flame retardant fabric and/or a flame retardant fiber batting. The bottom layer may include filaments, attached to fibers, that repel liquids and oils at a molecular level. The fastener may include one or more a zippers, loop and hook fasteners and/or Velcro®.

A removable padding layer may be disposed between the bottom layer of the removable panel and the upper deck. Advantageously, the removable padding layer can be placed in a recess or pocket formed between the bottom layer of the removable panel and the mattress deck, with the pocket having a depth corresponding to the thickness of the removable padding layer.

The removable panel can be cleaned in an inverted configuration which exposes the top layer of the removable panel to a cleaning fluid for cleaning and/or to drying air. For example, the fastener can be implemented as a zipper having two zipper section. The top zipper section is attached along the perimeter of the removable panel can have two starting pins and the bottom zipper section is attached to the upper mattress deck. After the panel has been removed from the mattress deck and folded with the top layer facing outwardly and the bottom layer facing inwardly, one end of the top zipper section can engage with the opposite end of the top zipper section so that the panel, when removed from the mattress deck, is zipped together in an inverted configuration, with the top layer facing outwardly and the bottom layer facing inwardly. In an alternative embodiment, the fastener can be implemented as two zippers, with each zipper extending approximately halfway around the perimeter of the removable panel. After the panel has been folded as before, the top zipper section of the first zipper attached to the removable panel can engage with the top zipper section of the second zipper attached to the removable panel, so that the panel can be zipped together in an inverted configuration for cleaning.

BRIEF DESCRIPTION OF THE DRAWINGS

The foregoing and other objects and advantages of the invention will be appreciated more fully from the following further description thereof, with reference to the accompanying drawings wherein.

DESCRIPTION OF CERTAIN ILLUSTRATED EMBODIMENTS

To provide an overall understanding of the invention, certain illustrative embodiments of a mattress construction with a removable, quilted and machine-washable top layer will now be described. However, it will be apparent to those of skill in the art that other embodiments of the invention may be realized and that the embodiments described herein are for purposes of illustration.

In one particular embodiment, the mattress includes a top layer that may be attached to the upper deck of the mattress by a releasable fastener, such as a zipper, and can be washed multiple times, including in hot water wash and hot air dry cycle. To this end, the top layer may include a fastener that, in one mode of use, secures the top layer to the mattress, and in a second mode of use, secures the fastener to the top layer, so that the fastener does not harm the top layer while being machine washed. It will be understood by one of ordinary skill in the art that the mattress construction and top layer described herein may be adapted and modified and applied in other applications, such as cushions, car seats, sofa coverings, and other articles of furniture, and that such other additions, modifications and uses will not depart from the scope of the invention.

Figure 1:
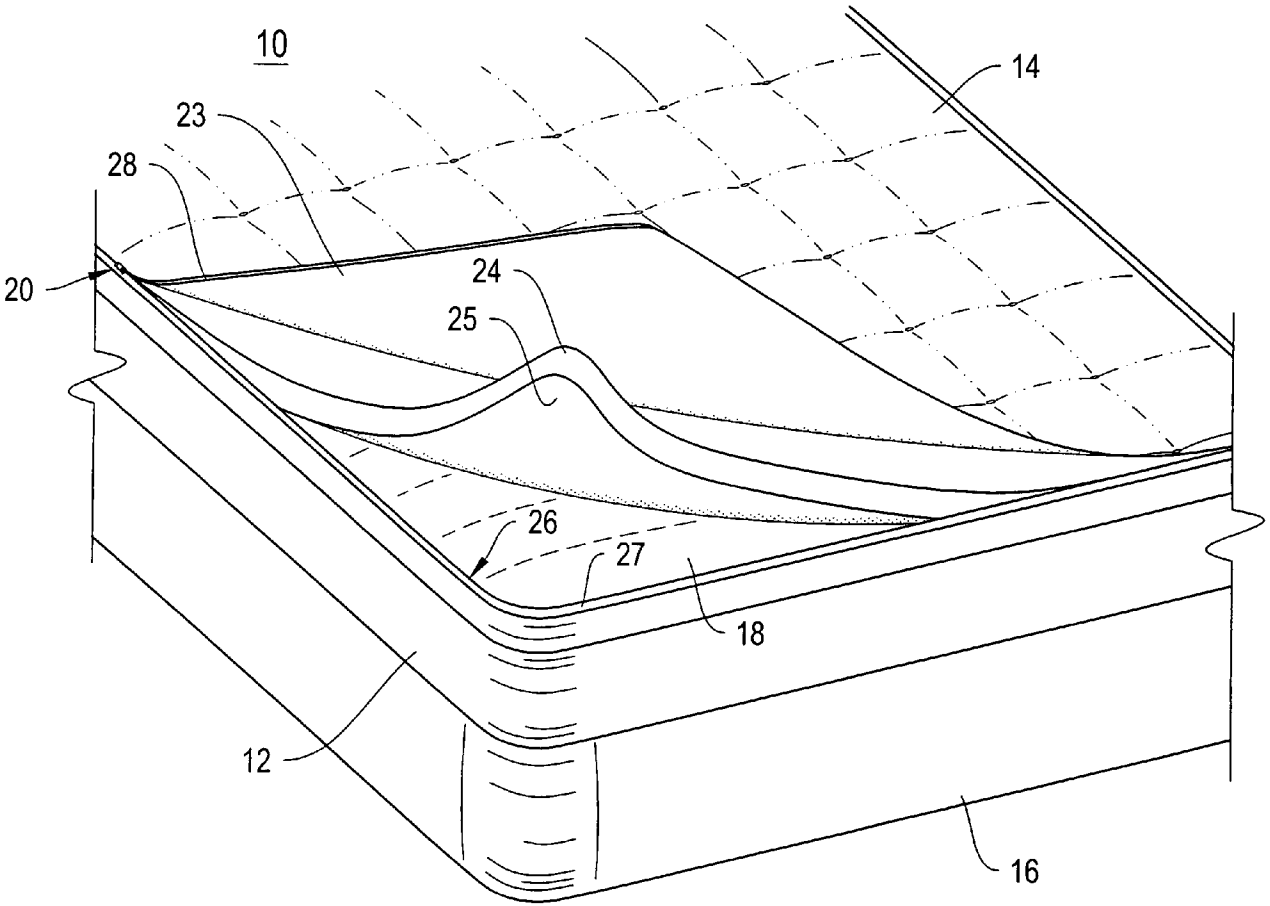
FIG. 1 illustrates a mattress with a quilted deck layer and a partially removed removable top layer.

FIG. 1 shows a perspective view of a bedding construction 10 that includes a mattress 12 and an optional support 16, such as a box spring or foundation, which can be supported on a frame (not shown). The foundation 16 may be conventional, adjustable and optionally may be absent for the bed. The mattress 12 may have, for example, an inner spring core or a foam core of the type known in the art. At least one major surface 18 of mattress 12 includes the removable panel 14. However, the mattress 12 may be a two-sided mattress, in which case both major surfaces may be sleeping surfaces and can optionally include a removable panel 14. The depicted mattress 12 may be a one-sided or two sided mattress. It may have a foam core, a spring core, a pocketed coil core, a visco-elastic core or a core that combines foam and coils to provide a support structure for the sleeping user.

The depicted removable panel 14 substantially overlies the top surface 18 of the mattress 12, protecting the inner spring and/or foam core from damage or soiling. The depicted removable panel 14 is removably fastened to the top surface 18 of the mattress 12, for example, by a zipper 20 that preferably extends around the entire periphery of the mattress body, as shown in FIG. 1. Optionally other attachment mechanisms, such as hook and loop fasteners, Velcro®, buttons, snaps, drawstrings and/or combinations of such fasteners may be employed. As depicted in FIG. 1, the major surface 18 of mattress 12, also referred to as upper deck, can be quilted. In the embodiment depicted in FIG. 1, the removable panel 14 comprises a top layer 23 and a separate pad of batting 24 that is disposed between the top layer 23 and the upper deck 18 of the mattress body of mattress 12. As further depicted in FIG. 1, the pad of batting 24 may be secured against the upper deck 18 by using the zipper fastener 20 to secure the perimeter top layer 23 to the peripheral edge 26 of the mattress body. In the depicted embodiment of FIG. 1, the peripheral edge 26 of the mattress 12 comprises one or more strips of fabric, such as the fabric or fabrics employed as the upholstery material for the side panels of the mattress 12. In one embodiment, the peripheral edge 26 is secured, typically by stitching one edge of the fabric strip peripheral to the edge of the mattress 12. The opposite side of the fabric strip that forms the peripheral edge 26 may include a zipper strip 27 of the type that includes teeth that may be joined to an opposing zipper strip by the zipper 20. In the depicted embodiment, the zipper strip 27 may be joined to an opposing zipper strip 28 that is attached, typically by stitching, to the perimeter of the top layer 23 of the removable panel 14. A portion of that zipper strip 28 is shown in FIG. 1, with the remainder of the zipper strip 28 being obscured by the top layer 23, which has been folded back to expose the batting layer 24 and upper deck 18.

As mentioned above, a mattress 12 may eventually have to be cleaned. Moreover, the mattress core, i.e., the foam or coil spring core, benefits from being protected from moisture and/or spills which can degrade the core material. Several approaches may be implemented, with protection of the mattress core being provided either by a water-impermeable sheet placed between the panel 14 and the mattress deck 18, or by incorporating into the mattress deck 18 a layer acting as a water/moisture barrier. Use of a separate sheet that may be laid on top of the deck 18, may also be used, but it is understood that this technique has certain disadvantages: for example, if the water-impermeable sheet is a separate item, it must be carefully placed on the mattress deck 18 before the panel 14 is applied so as to prevent bunching, folding or creasing, which can be uncomfortable to the occupant. There is also the risk that a water-impermeable sheet may accidentally be misplaced. Further, placing water/moisture barrier directly over a nylon layer on the mattress deck 18 may obstruct air circulation and may cause, for example, formation of mildew, if it is not removed and cleaned periodically.

Figure 2:
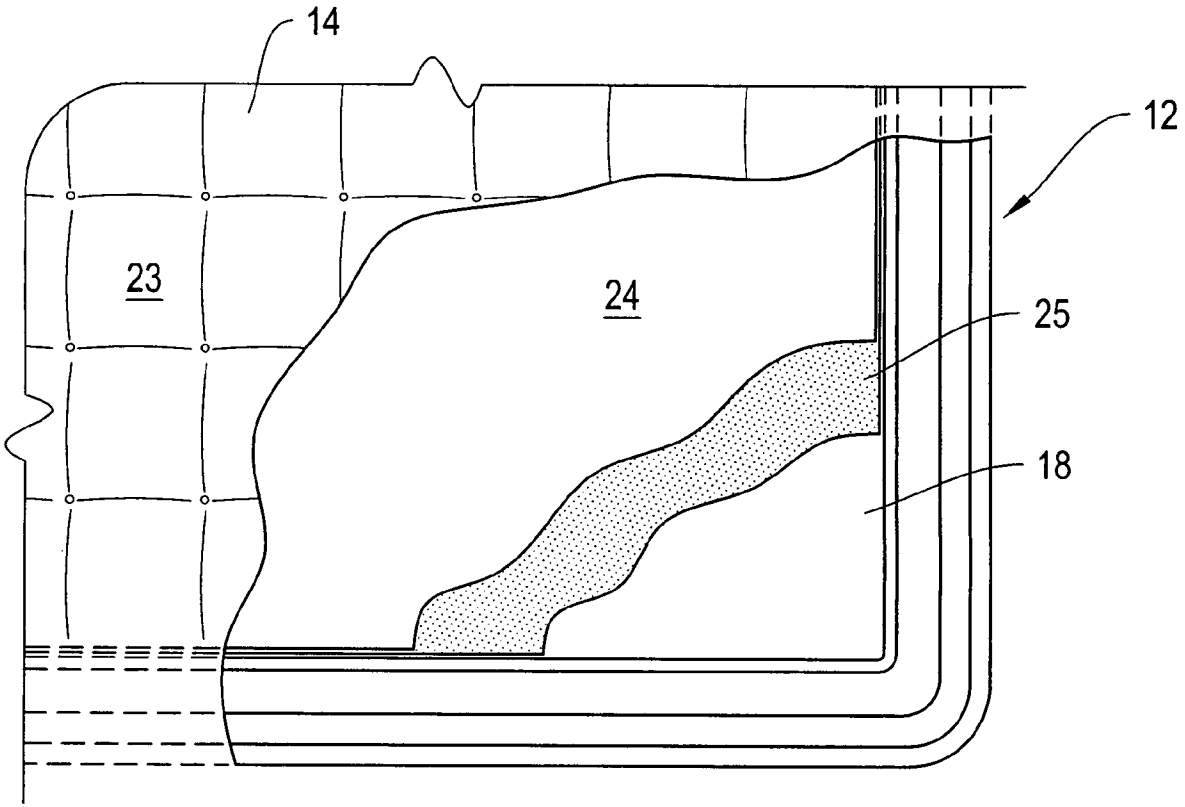
FIG. 2 is a partial top plan view, partially broken away, of the mattress depicted in FIG. 1, showing details of the construction of the removable top.

It would therefore be preferred, but not required, to form a bottom layer of panel 14 as a water/moisture barrier, as shown in the embodiments depicted in FIGS. 1 to 3. This allows the water/moisture barrier to be removed with the top layer 14 and cleaned as desired.

As indicated in FIG. 1, and shown in more detail in FIG. 2 in a partially broken away top plan view, the removable panel 14 may be implemented as a padded upholstery layer with a quilted top that represents the actual sleeping surface. Specifically, the panel 14 may be made of several component layers 23, 24, 25, such as a top layer 23 that is a quilted upholstery layer intended to serve as the sleeping surface, a batting layer 24 providing cushioning and softness to the sleeping surface, and a bottom layer 25 facing the mattress deck 18. The top layer 23 can be quilted and made, for example, of a water shedding fabric, such as the CoolMax® material available from the Invista Company. CoolMax® is a tetra-channel polyester, which pulls, or "wicks", moisture away from the user's skin and to the outer layer of the fabric. The larger surface area of the tetra-channel fiber is understood to cause moisture to evaporate quickly and roll or shed from the fiber more quickly than other fibers. This material is commercially available and is used in a variety of apparel, sports accessories and medical wraps, braces and pads. Cotton absorbs and retains 14 times more moisture than CoolMax®, and polypropylene does not wick moisture away from the skin, as CoolMax® does. CoolMax® fabrics are understood to be washable, dryable, and to stay soft. They also are understood to resist shrinking, odors and mildew. Although the depicted embodiment includes a CoolMax® fabric layer, it will be apparent to those of skill in the art that this is just one example of a material having the water shedding characteristics of interest and that any suitable material may be employed without departing from the scope of the invention. For example, the removable panel 14 may employ other commercially available wicking fabrics such as PowerDry® Mesh, which is a soft knit, or a thin layer of Polartec® 100 thermal piqué, as well as any material that comprises fibers or threads made up of a bundle of hydrophobic fibers having a large surface area and longitudinally extending channels to provide improved moisture shedding and quicker drying, as well as fabric blends including such threads, and polyester and polyester blends having improved moisture shedding characteristics.

Figure 3A:
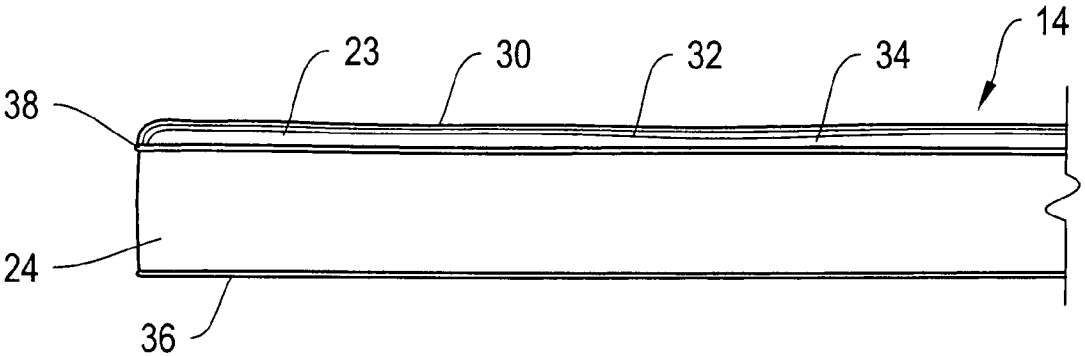
FIGS. 3A and 3B illustrate cross sectional views of a removable top.
Figure 3B:
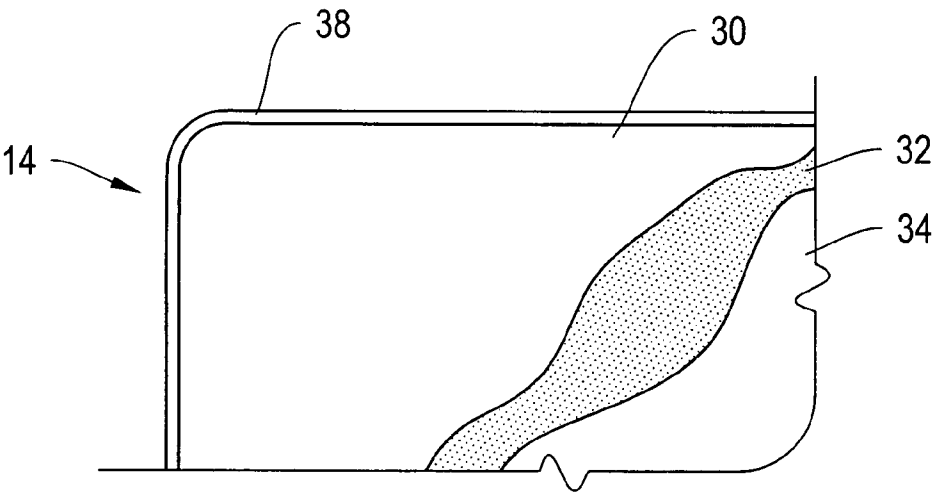

The batting layer 24 may be polyester fiber, polyurethane foam or any suitable material, and may further include a halogenated fiber component or other fire retardant or flame resistant material that resists an open flame to reduce the likelihood of combustion. Alternatively, the batting layer 24 may be encased in a flame resistant bag or pouch. These embodiments are depicted in FIGS. 3A and 3B, specifically, FIGS. 3A and 3B depict embodiments of the removable panel 14 that provide a flame resistant removable layer 14 that can reduce the likelihood of combustion upon exposure to an open flame and/or can emit a reduced level of fumes and gases upon combustion. FIG. 3A depicts a side view cross-section of one such removable panel 14. The removable panel 14 has a top layer 23 that includes an outer fabric layer 30 that typically comprises a fabric ticking, a fire barrier layer 32, that may comprise a flame resistant material such as Kevlar®, or a halogenated fabric material, and a layer 34 of foam padding. The components of the top layer 23 may be joined by a seam of stitching 38 and may optionally be attached to the batting layer 24. This is shown in a cutaway plan view in FIG. 3B. Also shown in FIG. 3A is that the batting layer 24 may optionally be encased in a flame resistant layer, such as a layer of Kevlar®, that surrounds all of the batting, or the sides of the batting pad that are not adjacent to the top layer 23.

Although foam may be used in the batting layer 24, a batting material such as polyester fiber, is preferred as it provides greater durability over multiple washings. The batting layer 24 may comprise Coolmax®, alone or in combination with some other batting material, or any other suitable batting material. In addition, the cellular nature of foam tends to retain water when washing or when soiled, making it difficult to dry thoroughly, resulting in liquid retention and subsequent mold and/or mildew growth. These other materials shed water quickly and can shed a substantial volume of water during the washing machine spin-cycle, making the panel 14 more easy to lift from the washing machine. The bottom layer 25 may be made of a water or moisture resistant material, such as Nanopel™ material from Burlington House, serving as a moisture barrier, and may be sealed to the top layer 23 at the peripheral edges to preserve the imperviousness to moisture of the removable panel 14. This peripheral seal eliminates needle holes caused by stitching through the moisture barrier, and reduces the likelihood that water will pass through to the mattress core.

In one embodiment, the removable panel 14 includes at least three layers of fabric, each serving a function. One layer includes a channeled fiber material, such as Coolmax®, and may serve to wick away moisture as the user sleeps and to allow the removable panel 14 to dry quickly in the laundry. A layer of fabric that may trap or impede fluids, such as Nanotex® or a similar material, may trap fluids and particles before they pass into the mattress body, allowing them to be washed away. Optionally, a layer of terry cloth treated with Teflon® fabric protector may be used to provide an extra layer of protection.

Figure 4:
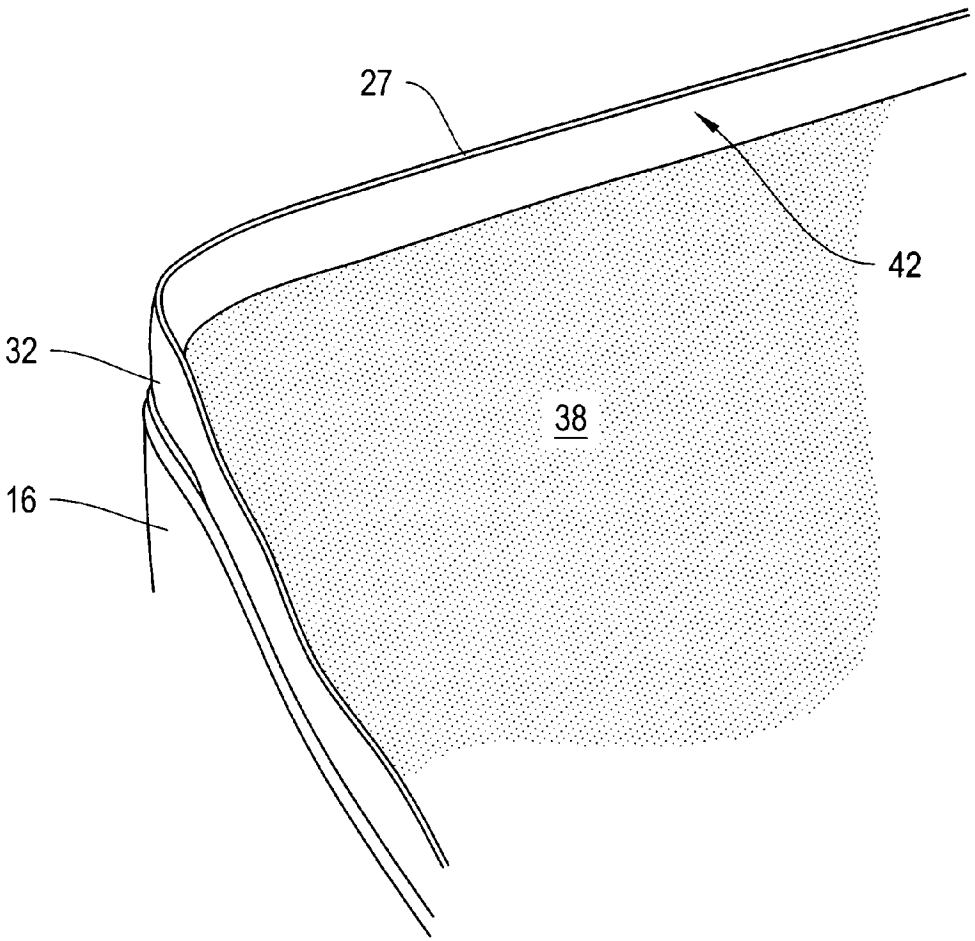
FIG. 4 shows in more detail the upper deck of the mattress of FIG. 1.

FIG. 4 shows the mattress of FIG. 1 from a different perspective view and without the removable panel 14. The depicted mattress 32 sits upon the optional support, such as a box spring or foundation 16. The mattress 32 has an upper mattress deck 38 with a flat (unquilted) surface. In this embodiment, the upper mattress deck 38 is typically not a sleeping surface and the removable panel 14 is to be secured to the mattress 32 to provide a sleeping surface. FIG. 4 shows in more detail that the upper surface of the mattress 32 may comprise the upper deck 38 that can receive the removable panel 14 and may comprise a strip of fabric 42, such as the fabric employed as the upholstery material for the side panels of the mattress 12. The strip of fabric 42 forms a sidewall around the perimeter of the upper deck, such that the upper deck 38 forms a recessed surface that can receive the removable panel 14. In one embodiment, the fabric strip 42 is secured, typically by stitching one edge of the fabric strip 42 to the peripheral edge of the mattress 32. The opposite side of the fabric strip 42 may include a zipper strip 27 of the type that includes teeth that may be joined to an opposing zipper strip by the zipper 20 (shown in FIG. 1). FIG. 4 shows that the height of sidewall 42 formed between the zipper strip 27 and the mattress deck 38 may be selected to substantially correspond to the thickness of the padding layer 24 so as to facilitate insertion of the padding layer 24 and closure of zipper 20.

The upper deck 38 may optionally comprise a moisture resistant fabric layer, that is spread across the upper deck 18 and sealed at the peripheral edge of the mattress 32. The moisture resistant layer may be nylon, Weblon available from the Weblon, Inc. company or any other suitable material. Additionally and optionally, the upper deck 38 may comprise a sheet of flame resistant material that extends across the upper surface of the mattress 32. The flame resistant material on the upper deck 38 may join with, either integrally as a single layer or otherwise, a layer of flame resistant material that surrounds the sidewalks of the mattress 32 and the bottom of the mattress 32. The flame resistant material used in the mattress may be Kevlar®, a halogenated fabric, Basofil fiber, a flame-resistant melamine fiber commercially available from BASF, a flame-retardant Ultem polyetherimide resin or any other suitable material that can resist or reduce combustion of the mattress when exposed to a flame or heat source. These materials may be used as liners, layers and fabric enclosings that can be disposed within the mattress 32 to reduce likelihood or ability to combust or ignite.

Figure 5:
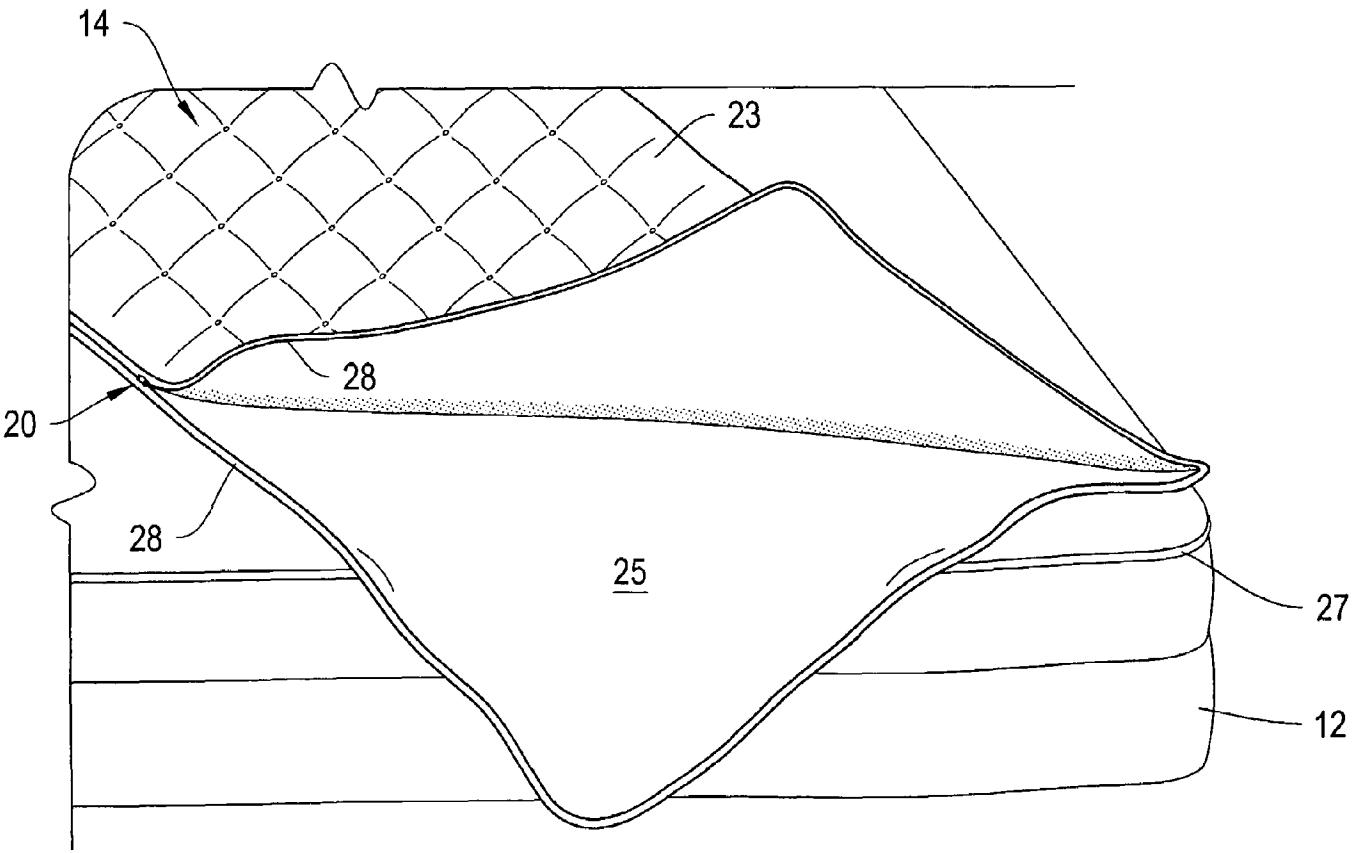
FIG. 5 shows the removable top in a partially closed inverted arrangement for washing.

FIG. 5 shows the removable panel 14 in a partially closed and inverted arrangement for machine-washing and/or machine-drying by exposing substantially only the top layer 23 to the suds during the wash cycle and to the warm air during the drying cycle. The removable panel 14 has a zipper strip 28 that extends about the out perimeter of the panel 14 and allows the panel 14 to be fastened to the mattress 12, which has an opposing zipper strip 27 that may be engaged with the panel's zipper strip 28 by operation of the zipper handle 20. In the embodiment depicted in FIG. 5, the zipper handle 20 is carried on the removable panel 14, however in other alternative embodiments, the zipper handle 20 may be included on the zipper strip 27 attached to the peripheral edge of the mattress body.

In the embodiment depicted in FIG. 5, the panel 14 includes a zipper strip 28 that has a first and second section, with each section having a separate starting pin, similar to a sleeping bag. A first section of the zipper strip 28 may extend along one half of the peripheral edge of the removable panel 14, and have a starting pin located at one end of the section and a zipper stop block located at the opposite end. The second section of the zipper strip 28 can form a mirror image to the first section, and can extend along the opposing half peripheral edge of the removable panel 14, with a starting pin located at one end of this section, and proximate to the other starting pin so as the pins may be inserted into the zipper handle 20. In operation, the zipper handle 20 may be attached to one section of the strip 28, and may be slid down to and over one of the starting pins. The other starting pin may be inserted into the zipper handle 20 thereby allowing the panel 14 to be zipped closed by zipper handle 20 joining the two sections of the zipper strip 28, and forming the panel 14 into an inverted configuration, with the top layer 23 that forms the sleeping surface facing outward and the bottom layer 25 that forms the water/moisture barrier being facing inward.

Figure 6:
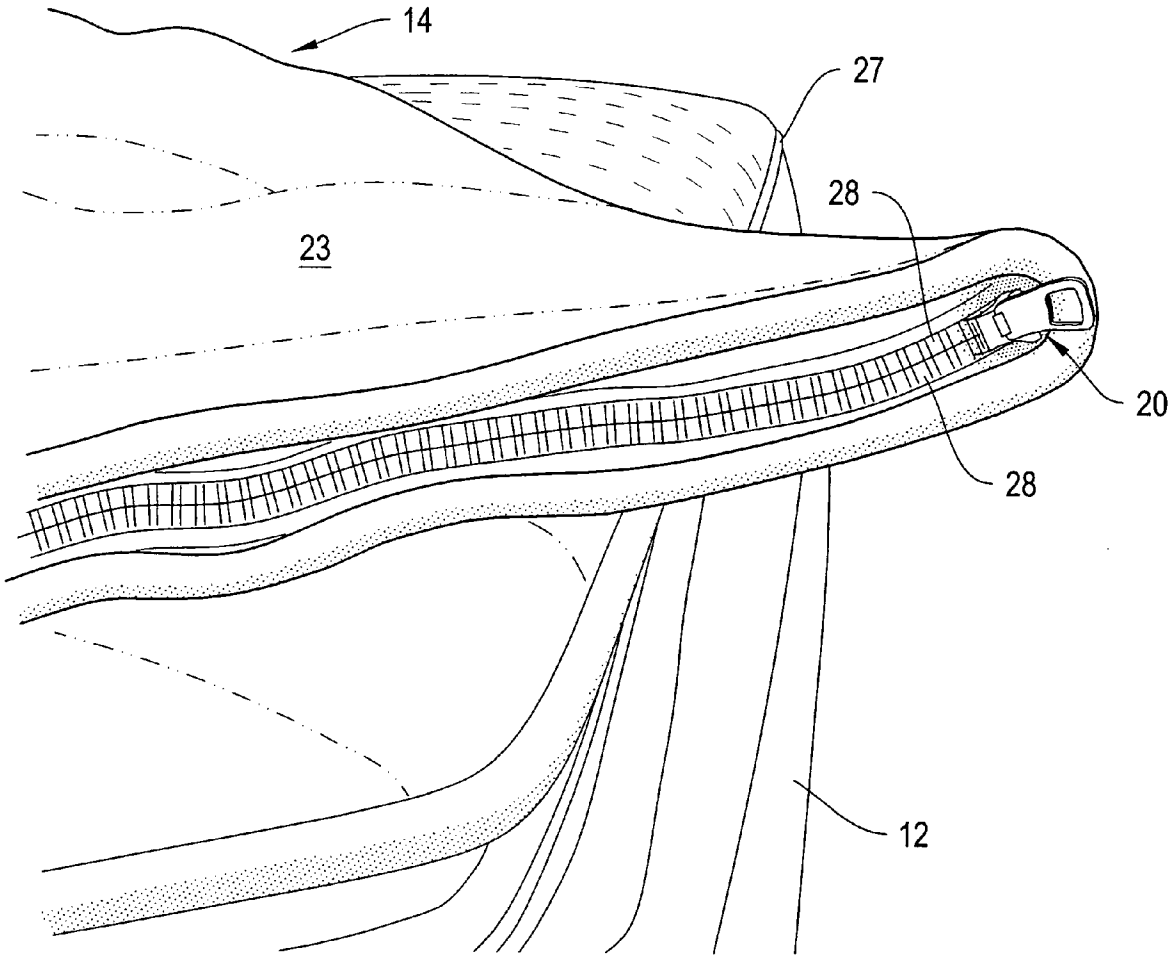
FIG. 6 shows the removable top fully closed with a zipper arranged to prevent damage to the tick.

FIG. 6 shows in more detail the fully closed top layer 23, ready to be washed. The removable panel 14, in one embodiment, would be folded in half, so that the two sections of the zipper strip 28 are aligned, and may be joined by sliding the zipper handle 20 over the two aligned starting pins (not shown) and over the two sections of zipper strips, to join the zipper strips together, as is shown in FIG. 6. In particular FIG. 6 shows the removable panel 14 folded in half so that the two sections of zipper strip 28 are folded, one on top of the other. As the zipper handle 20 is pulled across the aligned strips 28, the strips are joined to each other, and the exterior layer 23 is exposed. It is this layer 23 that the user sleeps on, and it is this side of the panel 14 that is exposed during the washing process. During the washing process the zipper strips 28 are fastened together. This helps prevent the zipper teeth from tearing or pulling at the fabric during the wash cycle. This can increase the longevity of the removable panel 14. As can be seen, a small pocket can be formed where the two zipper sections of zipper strip 28 meet; the zipper handle 20 can be inserted in a zipper pocket to prevent damage to the ticking and/or to prevent the handle 20 from becoming detached and/or damaging the fabric during the wash/dry cycle. Although only one zipper handle 20 is shown, it will be understood that more than one zipper handle 20 can be employed, with the slider of one of the zippers associated with the zipper strip 28 attached to the removable top 14 and the slider of another zipper associated with the zipper strip attached to the mattress deck 38.

In an optional embodiment, the fastener employed to join the removable top 14 to the peripheral edge of the mattress 12 may include a zipper mechanism of the type described above, and a length of hook and loop fastener that extends along a portion of the peripheral edge of the removable panel 14 and the peripheral edge of the mattress 12. In particular, in some embodiments, the zipper may extend along substantially the entire length of the peripheral edge of the mattress 12 and the removable panel 14. A gap may be left that provides a section, typically a half inch to six inches in length, on the peripheral edge of the mattress 12 and removable panel 14, where a hook and loop fastener may be placed. When securing the removable panel 14 to the mattress 12, both the zipper and the hook and loop fasteners will be employed to secure the removable top 14 to the full length of the peripheral edge of the mattress 12. The hook and loop fastener provides some adjustability to the length of the fastener. From time to time the user may get a replacement top for the mattress and the number of teeth in the zipper strip 28 may not match exactly with the number of teeth in the zipper strip 27. Consequently, the zipper 20 may not be able to join completely the two zipper strips 27 and 28. In those cases the hook and loop fastener may be disposed so as to overlap a portion of the zipper strips 27 and 28, and provide for an auxiliary fastener at this section. Moreover, in those cases when the removable panel 14 has been recently laundered, it may be that when it is first placed onto the mattress, it fits tightly enough that it is difficult for the user to zipper the removable completely to the mattress 12. In those cases, the user may employ the hook and loop fastener to fasten a final section of the peripheral edge of the panel 14 to the mattress 12.

Figure 7:
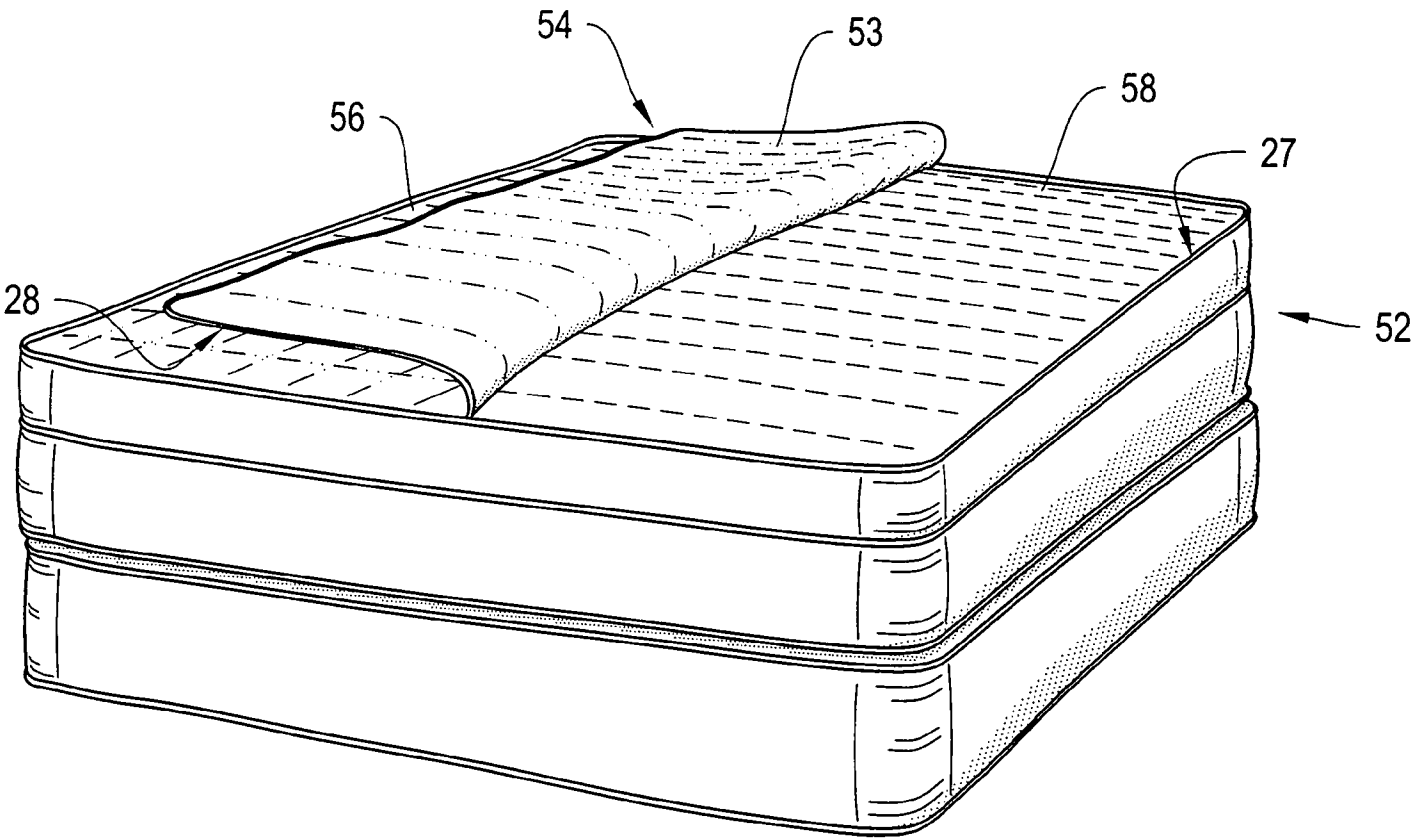
FIG. 7 depicts an alternate embodiment of the invention.
Figure 8:
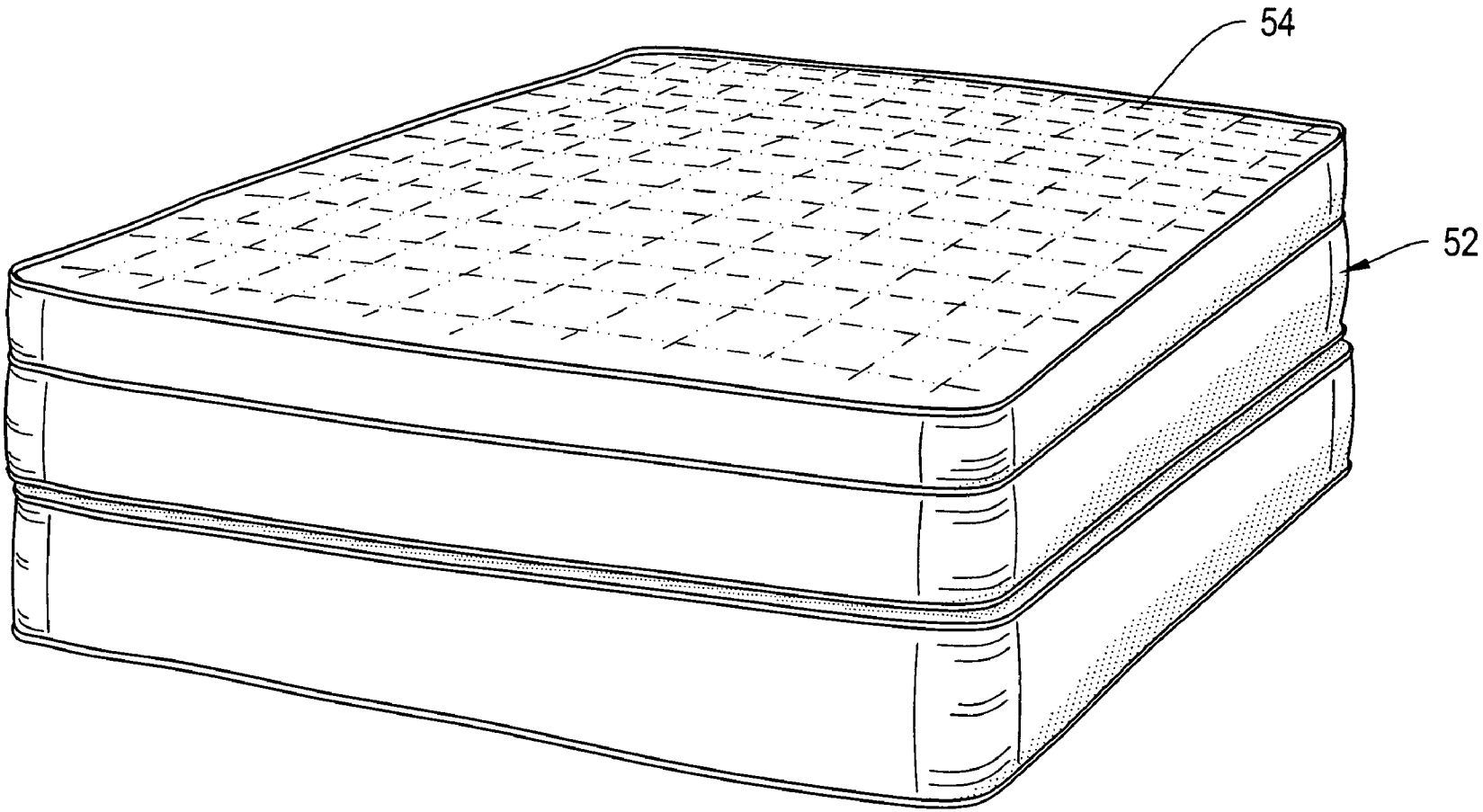
FIG. 8 depicts that mattress of FIG. 7 with the removable top layer fully attached to the mattress.

FIGS. 7 and 8 depict an alternate embodiment of the invention. In particular, FIGS. 7 and 8 depict a mattress 52 that has a removable panel 54 that is disposed over an upper deck 58 that includes a quilted, upholstered and padded layer. More particularly, FIG. 7 depicts a removable panel 54 that is partially fastened to the upper deck 58 of a mattress 52. The removable panel 54 is shown as folded back onto itself, leaving half of the upper deck exposed, and half of the upper deck covered. FIG. 8 depicts the panel 54 fully attached to the mattress 52. In contrast to the embodiment depicted in FIG. 1, the mattress 52 of FIGS. 7 and 8 has an upper deck 58 that is formed as a sleeping surface. In particular, FIG. 7 shows that the upper deck 58 has a padded quilted surface. This upper deck 58 may include a layer of upholstery, covering one or more layers of padding, that sit above the mattress core. The zipper strips 27 extend about the outer edge of the mattress and can join to the zipper strips 28 on the peripheral edge of the removable panel 54. The removable panel 54 is provided as an upper upholstered layer that may be fastened to the upper deck 58 at the peripheral edge of that deck 58 to protect that sleeping surface. The construction of the panel 54 is as shown with reference to FIGS. 2-3, however, the batting layer has a typically reduced thickness, as the removable panel 54 is not required to provide a layer of padding for the sleeping surface. The removable panel 54 can have a quilted upper layer 56 and a moisture resistant bottom layer 53. A layer of batting material (not shown) may be disposed between these two layers. Optionally, a flame resistant material may be added to the removable panel 54.

The removable panel 14 optionally may have a controllable and predictable amounts of shrinkage over the multiple wash and dry cycles. This may be achieved by pre-washing the top layer 23 made of CoolMax® fabric before assembling the panel 14. Shrinkage data obtained for the CoolMax® fabric over multiple wash cycles show that the shrinkage depends on the orientation of the fabric (weft/warp), with an average shrinkage of approximately 1.5% after 12 washings. The removable layer 23 can therefore advantageously be pre-shrunk before being attached, for example by quilting, to the batting 23 and bottom layer 25 with an appropriate level of tightness, to provide a tightly fitting panel 14 for the mattress 12.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A mattress comprising a mattress body having an upper deck and a peripheral edge encircling the upper deck;

a removable panel having a top surface and disposed on the upper deck of the mattress body with the top surface exposed, said removable panel having a top layer of breathable fabric, a moisture barrier layer, a batting layer and a flame retardant fabric layer; and a fastener for removably attaching the removable panel to the mattress body in a first configuration, and having a means for joining at least two sides of the removable panel in a second configuration, wherein the at least two sides of the removable panel are fastened together in an inverted folded configuration with the top surface facing outwardly and the removable panel is detached from the mattress body.

2. The mattress of claim 1, wherein the top layer of fabric comprises fibers with channels dimensionally adapted to enhance air and moisture permeability.

3. The mattress of claim 1, wherein the removable panel has a batting layer that includes polyester fiber batting.

4. The mattress of claim 1, wherein the removable panel has a batting layer that includes a flame retardant fiber batting.

5. The mattress of claim 1, wherein the fastener further includes a loop and hook fastener.

6. The mattress of claim 1, wherein the moisture barrier layer comprises filaments, attached to fibers, that repel liquids and oils at a molecular level.

7. The mattress of claim 1, further comprising a flat upper deck including a layer of moisture resistant material joined to the mattress body at the peripheral edge.

8. The mattress of claim 1, wherein the fastener comprises a zipper with a first zipper strip attached along a perimeter of the removable panel and a second zipper strip attached to the peripheral edge of the upper deck, said first zipper strip having two starting pins, whereby for cleaning purposes, a first end of the first zipper strip is engaged with an opposite end of the first zipper strip so that the removable panel is zipped together in an inverted configuration, with the top surface facing outwardly.

9. The mattress of claim 1, wherein the fastener further includes a first zipper and a second zipper, extending approximately halfway around the perimeter of the removable panel, wherein after the panel is removed from the upper deck and folded with the top layer facing outwardly, a first zipper strip of the first zipper attached to the removable panel engages with a second zipper strip of the second zipper attached to the removable panel, so that the panel is zipped together in an inverted configuration for cleaning.

10. The mattress of claim 1, wherein the inverted configuration exposes the top layer of the removable panel to a cleaning fluid for cleaning, or to drying air, or both.

11. The mattress of claim 9, wherein the inverted configuration exposes the top layer of the removable panel to a cleaning fluid for cleaning, or to drying air, or both.

12. The mattress of claim 9, wherein a pocket is formed when the panel is zipped together, said pocket receiving a zipper handle to prevent damage to the removable panel during cleaning.

13. The mattress of claim 1, wherein the fastener further comprises a strip of hook and loop fastener attached to the peripheral edge and abutting the zipper, whereby a portion of the perimeter of the removable panel is attached to a portion of the peripheral edge of the mattress body by operation of the hook and loop fasteners.

14. The mattress of claim 1, further comprising a removable padding layer disposed between the bottom layer of the removable panel and the upper deck.

15. The mattress of claim 14, further comprising a pocket formed between the bottom layer of the removable panel and the upper deck, said pocket having a depth corresponding to a thickness of the removable padding layer.

16. The mattress of claim 1, further comprising a substantially rigid lower layer having one or more layers of foam.

17. The mattress of claim 1, wherein a pocket is formed in the removable panel, said pocket for receiving a portion of the fastener to prevent damage to the removable panel during cleaning.

18. A removable panel for use with a mattress or cushion, comprising a top layer of breathable fabric, a moisture barrier layer, and a batting layer, a flame resistant material incorporated therein to resist combustion, and a fastener for removably attaching the removable panel to the mattress body in a first configuration, and having a means for joining at least two sides of the removable panel in a second configuration1 wherein the at least two sides of the removable panel are fastened together in an inverted folded configuration with the top surface facing outwardly and the removable panel is detached from the mattress body.

19. The panel of claim 18, wherein the batting layer includes a flame retardant fiber batting.

20. The panel of claim 18, wherein the moisture baffler layer comprises filaments, attached to fibers, that repel liquids and oils at a molecular level.

21. The mattress of claim 18, wherein a pocket is formed in the removable panel, said pocket for receiving a portion of the fastener to prevent damage to the removable panel during cleaning.

* * * * *

UNITED STATES PATENT AND TRADEMARK OFFICE

CERTIFICATE OF CORRECTION

PATENT NO. : 7,587,775 B2
APPLICATION NO. : 12/077632
DATED : September 15, 2009
INVENTOR(S) : DeFranks et al.

It is certified that error appears in the above-identified patent and that said Letters Patent is hereby corrected as shown below:

In Claim 18, column 10, line 33, please replace "configuration1" with --configuration,--;

In Claim 20, column 10, line 40, please replace "baffler" with --barrier--.

Signed and Sealed this

Seventeenth Day of November, 2009

David J. Kappos

David J. Kappos
*Director of the United States Patent and Trademark Office*